US012753033B2

(12) United States Patent
Kupka et al.

(10) Patent No.: US 12,753,033 B2
(45) Date of Patent: Oct. 6, 2026

(54) APPARATUS FOR CONNECTING LABEL TAPES

(71) Applicant: Krones AG, Neutraubling (DE)

(72) Inventors: Martin Kupka, Landau (DE); Tobias Eichhammer, Bad Abbach (DE)

(73) Assignee: KRONES AG, Neutraubling (DE)

( * ) Notice: Subject to any disclaimer, the term of this patent is extended or adjusted under 35 U.S.C. 154(b) by 69 days.

(21) Appl. No.: 18/888,793

(22) Filed: Sep. 18, 2024

(65) Prior Publication Data

US 2025/0091829 A1 Mar. 20, 2025

(30) Foreign Application Priority Data

Sep. 18, 2023 (DE) ..... 102023125200.3

(51) Int. Cl.
*B65H 19/10* (2006.01)

(52) U.S. Cl.
CPC ... *B65H 19/102* (2013.01); *B65H 2301/4176* (2013.01); *B65H 2301/4633* (2013.01)

(58) Field of Classification Search
CPC .. B65H 19/10; B65H 19/102; B65H 19/1852; B65H 2301/4176; B65H 2301/4631
See application file for complete search history.

(56) References Cited

U.S. PATENT DOCUMENTS

| | | | | |
|---|---|---|---|---|
| 4,120,739 | A * | 10/1978 | Peeters | G03C 1/74 156/506 |
| 4,636,276 | A | 1/1987 | Nozaka | |
| 4,878,982 | A | 11/1989 | Ogata et al. | |
| 5,431,767 | A * | 7/1995 | Koza | B65H 19/102 156/577 |
| 9,051,072 | B2 | 6/2015 | Eder et al. | |
| 2002/0092621 | A1 | 7/2002 | Suzuki | |
| 2017/0137247 | A1* | 5/2017 | Sato | B65H 19/1842 |
| 2017/0341894 | A1* | 11/2017 | Muller | B65H 19/107 |
| 2022/0274798 | A1* | 9/2022 | Ahn | B65H 19/1852 |

FOREIGN PATENT DOCUMENTS

| | | | |
|---|---|---|---|
| CN | 115123641 | A | 9/2022 |
| DE | 102006043260 | A1 | 3/2008 |
| EP | 2825371 | B1 | 8/2018 |

* cited by examiner

*Primary Examiner* — Sang K Kim
(74) *Attorney, Agent, or Firm* — McCoy Russell LLP

(57) ABSTRACT

An apparatus for connecting label tapes, the apparatus comprising a feed-through region through which the label tapes can be guided along a transport direction, an adhesive application device for applying adhesive material to an adhesive region of a first label end of a first label tape, wherein the adhesive application device comprises an application element for applying the adhesive material in the adhesive region and a supply element for feeding a transfer tape with adhesive material to the application element and for discharging the transfer tape from the application element, wherein the apparatus comprises a first drive element for moving the application element along an application direction and a second drive element for driving the supply element for feeding and discharging the transfer tape.

13 Claims, 3 Drawing Sheets

APPARATUS FOR CONNECTING LABEL TAPES

CROSS REFERENCE TO RELATED APPLICATION

The present application claims priority to German Patent Application No. 10 2023 125 200.3 filed on Sep. 18, 2023. The entire contents of the above-listed application are hereby incorporated by reference for all purposes.

TECHNICAL FIELD

The present disclosure relates to an apparatus for connecting label tapes and to a method for connecting label tapes with an apparatus for connecting label tapes.

BACKGROUND

Apparatuses for connecting label tapes are known from the prior art in principle and are typically used, for example, to ensure the continuous transport of label tape to a labeling machine. For this purpose, an apparatus is known from EP 2 825 371 B1, for example, with which an adhesive tape dispenser is used to dispense adhesive tape in order to connect the film ends of successive film webs, such as label tapes.

SUMMARY

The applied adhesive tape is separated from the remaining adhesive tape on the adhesive tape roll by cutting. This can lead to contamination and protruding material ends of the adhesive tape, which can have a negative effect on the quality of the labeling result and the further operation of the apparatus.

Object

Based on the known prior art, the technical object to be achieved is therefore to specify an apparatus and a method for connecting label tapes, which enable a reliable connection of the label tapes.

Solution

This object is achieved by the apparatus for connecting label tapes and the method for connecting label tapes with an apparatus for connecting label tapes. Advantageous further developments are described herein.

The apparatus according to the disclosure for connecting label tapes comprises a feed-through region through which the label tapes can be guided along a transport direction, an adhesive application device for applying adhesive material to an adhesive region of a first label end of a first label tape, wherein the adhesive application device comprises an application element for applying the adhesive material in the adhesive region and a supply element for feeding a transfer tape with adhesive material to the application element and for discharging the transfer tape from the application element, wherein the apparatus comprises a first drive element for moving the application element along an application direction and a second drive element for driving the application element and/or the supply element for feeding and discharging the transfer tape.

According to the disclosure, the apparatus enables at least one application of adhesive material in the adhesive region of the first label end. Optionally, the apparatus can further comprise a connecting device for connecting the label end to a second label end of a second label tape. This apparatus can, for example, move the second label end towards the first label end after the application of the adhesive material, and press the second label end against the first label end, at least in the adhesive region, in order to achieve a connection.

With the second drive element, a pulling or pushing force is achieved according to the disclosure on the transfer tape by the application element and/or the supply element, so that it moves towards the application element and is conveyed away from the application element after the transfer of the adhesive material.

According to the disclosure, the adhesive material is supplied on the transfer tape in such a way that it can be detached from the transfer tape. In this respect, the transfer tape with the adhesive material is fed to the application element, and the application element causes a transfer of the adhesive material and a detachment of the adhesive material from the transfer tape, which is subsequently discharged from the application element by the supply element with no or substantially no remaining adhesive material. This can comprise, for example, unrolling a roll of transfer tape with adhesive material in the direction of the application element and rolling up a roll of transfer material without or substantially without adhesive material, wherein the rolling up occurs in the application direction after the application element.

The first drive element and the second drive element can in each case be designed as servo drives or other electric motors and can be connected to the supply element and/or the application element via suitable connecting elements and/or gears in order to be driven.

With the apparatus according to the disclosure, a transfer of the adhesive material is realized without remaining or protruding residues of adhesive material, which increases the quality of the connection of the label tapes and enables more reliable further transport.

It can be provided that the first and second drive elements can be operated independently of one another. Thus, it is possible to exert different torques or drive forces on the supply element and/or the application element, which enables a reliable transfer of the adhesive material, on the one hand, and a reliable detachment of the adhesive from the transfer tape, on the other hand.

In one embodiment, it is provided that the application direction is perpendicular to the transport direction. This ensures that as little adhesive material as possible is transferred to the label end, which reduces the required material usage.

The supply element can comprise a dispensing roll on which the transfer tape with adhesive material can be held, and a pick-up roll for picking up the transfer tape after discharge, and the second drive element can be designed to drive the pick-up roll about an axis of rotation of the pick-up roll, wherein the axis of rotation optionally runs parallel to the transport direction.

With this embodiment, reliable feeding and discharging of the transfer tape to the application element and from the application element can be ensured, wherein the torque acting on the transfer tape can be reliably controlled.

It can be provided that the apparatus further comprises a fixing element for fixing the first label end during application, wherein the fixing element comprises two pressure elements spaced apart in the transport direction, which can fix the first label end, and wherein the application element can apply the adhesive material to the adhesive region between the pressure elements. Alternatively, it can be provided that the apparatus comprises a fixing element for fixing the first label end during application, wherein the fixing element comprises a pressure element arranged downstream or upstream from the application element in the transport direction, which can fix the first label end. This can prevent unintentional misalignment between the adhesive material and the label end.

In particular, it can be provided that the fixing element and/or the application element is movable perpendicularly to a transport plane of the label tapes. With this embodiment, a reliable feeding through of the first label tape in the transport direction until the reaching of the first label end can be achieved, wherein a reliable transfer of the adhesive material to the label tape can subsequently be achieved.

In one embodiment, it is provided that the application element comprises an application roll for applying the adhesive material, and wherein the application roll is arranged rotatably about an axis of rotation parallel to the transport direction, and wherein the second drive element can drive the application roll about the axis of rotation, and/or wherein the second drive element can drive a deflection roll for deflecting the transfer tape about an axis of rotation of the deflection roll. In particular, the application roll can press the adhesive material onto the first label end and thereby achieve a reliable transfer.

The apparatus can comprise a control unit for controlling the first and second drive elements, wherein the first drive element and the second drive element can be operated synchronously during at least a first time interval and asynchronously during a second time interval.

In particular, synchronous operation comprises the distance traveled by the application element in the application direction being the same as the distance traveled by the adhesive material. Unintentional tearing of the transfer tape can thereby be avoided. The asynchronous operation can comprise the distance traveled by the transfer tape being different from the distance traveled by the application element along the application direction, and/or that a force different from the force acting on the application element in the direction of the application direction acts on the transfer tape. With this embodiment, reliable separation of the transfer tape from the applied adhesive material can be achieved, which reduces the residual excess adhesive material residues on the label end.

According to the disclosure, a method for connecting label tapes with an apparatus for connecting label tapes is furthermore provided, the apparatus comprising a feed-through region through which the label tapes can be guided along a transport direction, an adhesive application device for applying adhesive material to an adhesive region of a first label end of a first label tape, wherein the adhesive application device comprises an application element for applying the adhesive material in the adhesive region and a supply element for feeding a transfer tape with adhesive material to the application element and for discharging the transfer tape from the application element, wherein the apparatus comprises a first drive element for moving the application element along an application direction and a second drive element for driving the application element and/or the supply element for feeding and discharging the transfer tape, the method comprising driving the supply element for feeding the transfer tape to the application element, applying the adhesive material to the adhesive region, and discharging the transfer tape.

Optionally, after the application of the adhesive material to the first label end, a connection of the first label end to a second label end of a second label tape using a connecting device of the apparatus can be achieved.

With this method, a reliable transfer of the adhesive material is ensured.

It can be provided that the adhesive material comprises an adhesive layer detachable from the transfer tape or a substrate detachable from the transfer tape with adhesive layers arranged on opposite sides of the substrate.

An adhesive layer is understood here in particular to mean a material consisting solely of adhesive material without a non-adhesive substrate. The adhesive layers arranged on opposite sides of the substrate are to be understood together with the substrate to mean "double-sided adhesive tape," for example, so that adhesive layers are arranged on the opposite sides of the substrate (the flat sides). With these embodiments, a secure connection of the label ends can be ensured.

The application direction can run perpendicularly to the transport direction, and/or the supply element can comprise a dispensing roll on which the transfer tape with adhesive material is held, and a pick-up roll on which the transfer tape is picked up after discharge, and the second drive element can be designed to drive the pick-up roll about an axis of rotation of the pick-up roll, wherein the axis of rotation optionally runs parallel to the transport direction. Alternatively or additionally, it can be provided that the application direction runs perpendicularly to the transport direction and/or that the application element comprises an application roll for applying adhesive material, and wherein the second drive element drives the application roll about an axis of rotation, and wherein the axis of rotation optionally runs parallel to the transport direction. Furthermore, alternatively or additionally, it can be provided that the application element comprises a deflection roll for deflecting the transfer tape, and wherein the second drive element drives the deflection roll about an axis of rotation. In this embodiment, the material use of adhesive material can be reduced, and reliable transfer can be ensured at the same time.

It can be provided that the apparatus comprises a fixing element for fixing the first label end during application, wherein the fixing element comprises two pressure elements spaced apart in the transport direction, which fix the first label end at least temporarily during application, and wherein the application element applies the adhesive material to the adhesive region between the pressure elements. Alternatively, it can be provided that the apparatus comprises a fixing element for fixing the first label end during application, wherein the fixing element comprises a pressure element arranged downstream or upstream from the application element in the transport direction, which fixes the first label end during application.

Due to the fixing of the first label end, it is ensured that the adhesive material is applied to the first label end with as few creases as possible. This improves the reliability of adhesive material application.

It can also be provided that the fixing element and/or the application element are moved perpendicularly to a transport plane of the label tapes in the direction of the first label end prior to application. With this embodiment, the feeding through of the label tape can be ensured, and at the same time it can be ensured that the adhesive material is applied reliably.

In one embodiment, it is provided that the apparatus comprises a control unit that controls the first and second drive elements, wherein the first drive element and the second drive element are operated synchronously during at least a first time interval and asynchronously during a second time interval. With this embodiment, the force acting on the transfer tape can be controlled in a targeted manner, and the speed at which the adhesive material is transferred to the label tape can also be adjusted.

It can be provided that the first drive element and the second drive element are operated synchronously during application and are operated asynchronously for detaching the applied adhesive material from the transfer tape.

In this case, the synchronous or asynchronous drive can in particular comprise a higher torque of the supply element compared to the drive of the application element or a higher torque transmitted to the transfer tape so that this can be reliably detached from the adhesive material applied to the label end.

The asynchronous drive can be combined with a vertical movement of the application element and/or the supply element in a vertical direction to the label tape. This can advantageously achieve a detachment of the transfer tape from the adhesive material transferred to the label.

DETAILED DESCRIPTION

Figure 1:
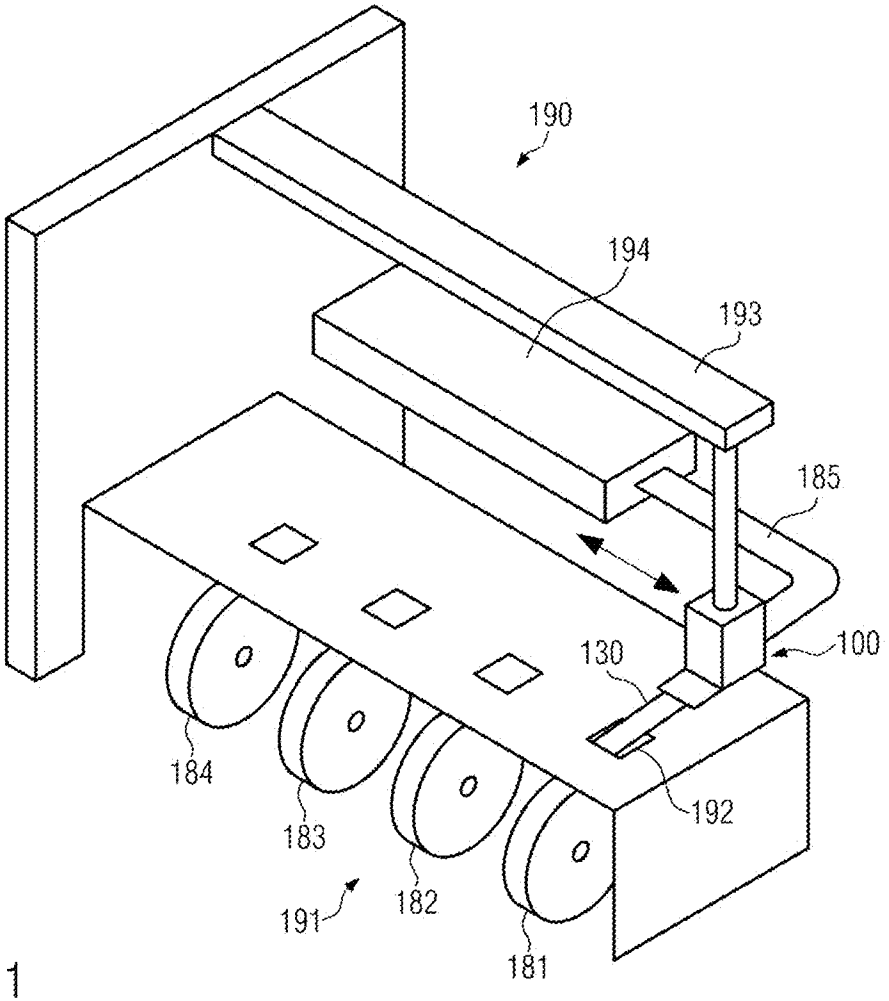
FIG. 1 shows an apparatus for supplying and feeding label tapes.

FIG. 1 shows an apparatus for supplying and connecting label tapes 190. This serves only as an example to illustrate the mode of operation of the apparatus 100 according to the disclosure for connecting label tapes, which is described in more detail starting with FIG. 2.

Apparatuses 190 are known in principle from the prior art. These comprise a plurality of label rolls 181 to 184 in which labels are held rolled up in the form of tapes. As is known, the labels can be provided as wrap-around labels or sleeve labels, or labels on a container that extend only partially along its circumference. Wrap-around labels or sleeve labels are known, which can be pulled over a container and completely surround it in the circumferential direction. The labels are held on rolls, wherein in particular with sleeve labels, labels follow one after the other on the label tape with their openings into which the container can be inserted.

The apparatus 190 further comprises, for example, one or more cutting apparatuses 192 for cutting an end of a label roll to be connected to the previous label roll. This label end 130 can then be transferred to an apparatus 100 according to the disclosure for connecting label tapes, wherein a connection between the label end of one label roll and the label end of the other label roll is ensured, so that a continuous label web 185 is produced which can be discharged from the apparatus, for example via a buffer system 194, and fed, for example, to a labeling machine for labeling containers (not shown here).

In order to enable the change of a plurality of label tapes or rolls (for example, a change between the label rolls 181 to 184 in the magazine 191 that is as automated as possible), it can be provided that the apparatus 100 according to the disclosure is arranged movably on a guide 193 so that it can be moved along the shown arrow direction, in order to be guided from a label roll that is currently unrolling to a further label roll or label tape 182 that is to be connected to this label roll or label tape. As soon as the currently unrolling label tape reaches a minimum remaining quantity, it can be provided that the apparatus 100 is moved along the guide 193 to the next label roll (here, the roll 182), and the label end of the first label roll 181 is connected to the label end of the second label roll 182.

In this connection, according to the disclosure, the term "label roll" is used synonymously with the term "label tape," since the label roll forms a rolled-up label tape.

Corresponding apparatuses of FIG. 1 are known in principle. Apparatuses 100 for connecting label ends are also known in principle. However, the problem typically arises in this case that it is only possible to reliably connect label ends of a first label tape and a second label tape following it with difficulty, which can lead to incorrect transfer of labels or readjustment of the label tapes during subsequent operation.

Figure 2:
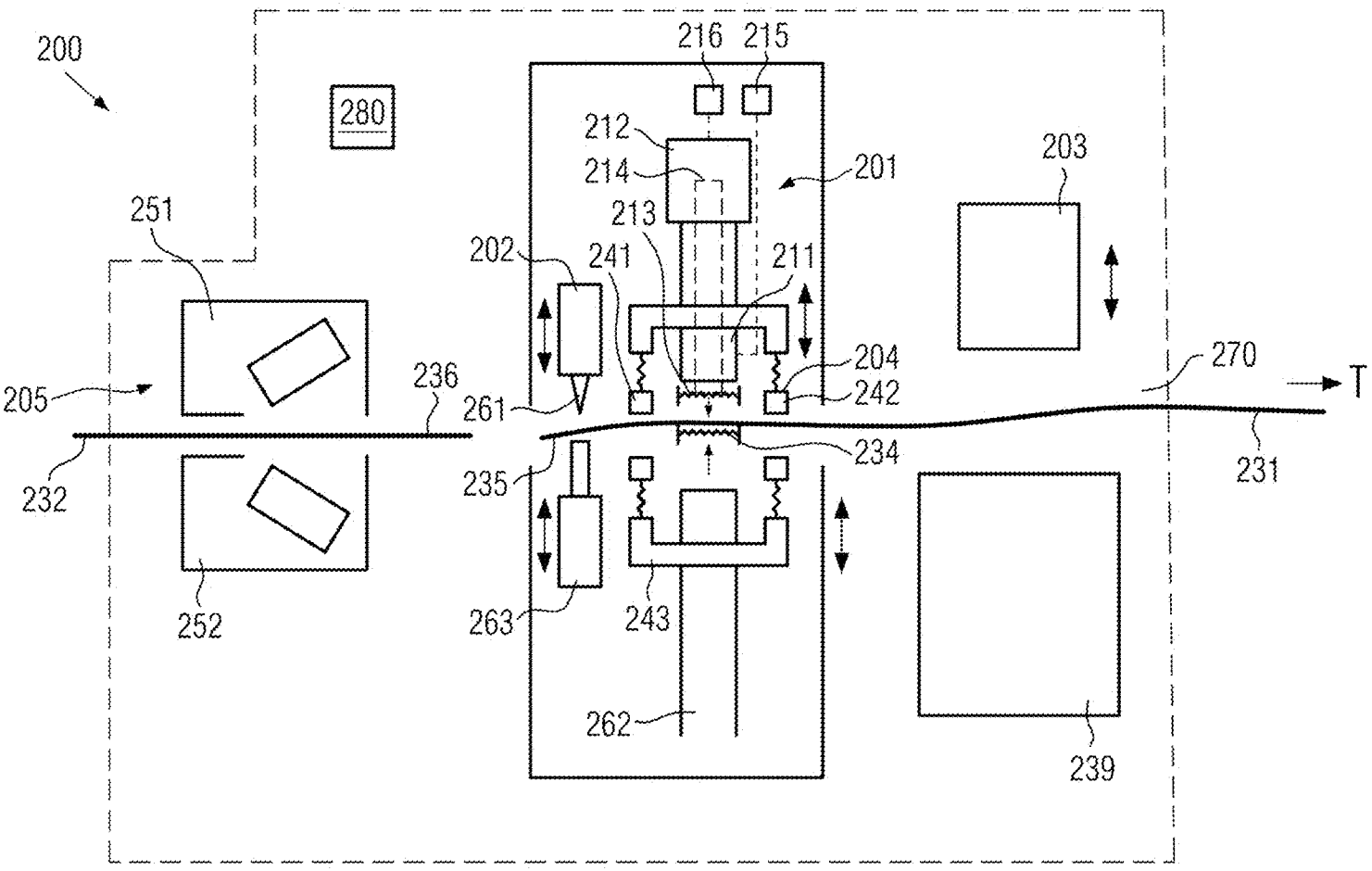
FIG. 2 shows a side view of an apparatus for connecting label tapes according to the disclosure.

FIG. 2 shows an embodiment of an apparatus 200 according to the disclosure for connecting label tapes 231 and 232. The label tapes can be label tapes that have been supplied on different label rolls.

While the apparatus is described below in such a way that the label end of a label tape 231 advancing in the transport direction T is provided with adhesive material 213, it is understood that the apparatus can also be used to provide the label end 236 of the following label tape (second label tape) 232 with corresponding adhesive material.

According to the disclosure, the apparatus comprises a feed-through region 270 through which the label tapes 231 and 232 can be fed through the apparatus 200. This can be achieved, for example, by providing suitable drive rolls or other drive elements upstream and/or downstream from the apparatus 200, which are designed to pull and/or push the label tapes, and to transport them through the feed-through region 270 along a transport direction T.

According to the disclosure, the apparatus 200 comprises an adhesive application device 201 which can apply adhesive material 213 to the label tape in an adhesive region 234 of the label end 235 of the first label tape 231. In the embodiment shown here, the adhesive application device 201 is arranged above the transport plane of the first label tape 231 in the transport direction T. In addition, in this embodiment, a second adhesive application device 262 is shown which can be arranged on the opposite side of the transport plane or the first label tape 231, and can apply adhesive material 213 to the opposite side of the label tape 231 in the adhesive region 234. This embodiment can be used if sleeve labels are in the form of label tapes. These are connected by pulling on the following or preceding label tape and "slipping" the label tape thus pulled over the label end of the other label tape and connecting it in the adhesive region 234. This requires the application of adhesive material on opposite sides of the label tape so that the label ends of the label tapes are reliably connected.

If the apparatus 200 according to the disclosure is provided for connecting label tapes of single labels (which do not form label sleeves or sleeve labels), the second adhesive application device 262 can be omitted.

The adhesive application device 201 comprises at least one application element 211 which can transfer adhesive material 213 in the adhesive region 234 to the first label end 235. For this purpose, the application element 211 can roll or roll on the adhesive material 213 or press it onto the adhesive region 213, for example.

Furthermore, the adhesive application device 201 comprises a supply element 212 which can feed the adhesive material on a transfer tape 214 to the application element 211. In this sense, the transfer tape 214 serves as a carrier for the adhesive material 213. Due to the application element, the adhesive material 213 and the transfer tape are detached from one another in the adhesive region, after the adhesive material 213 has been applied to the adhesive region 234 of the label tape. This can be achieved, for example, by pulling the transfer tape away from the label tape after the application of the adhesive material, so that a separation occurs in this case. Alternatively or additionally, the application element can also comprise a separating edge at which the transfer tape undergoes a change in its continuing direction of movement that is so great that the adhesive material cannot follow this change in direction of movement due to its rigidity and detaches from the transfer tape.

The transfer tape can, for example, be made of a plastic or a natural fiber or a mixture thereof and can in particular consist of or comprise PET or other plastics.

The adhesive material can either be arranged in the form of a single adhesive layer on the transfer tape (and can, for example, be created by vapor deposition or printing or spraying on the transfer tape) or can be provided in the form of a substrate with adhesive layers arranged on opposite sides of the substrate, such as double-sided adhesive tape. In any case, the adhesive material can be detached from the transfer tape.

According to the disclosure, the supply element feeds the transfer tape with adhesive material arranged thereon to the application element and discharges the transfer tape from the application element after the adhesive material 213 has been applied in the adhesive region 234. The feeding and discharging can either be actively achieved by the supply element by actively driving the supply element for feeding and/or discharging, or the feeding and discharging can be passively achieved by the supply element, for example by the transfer tape being pulled off the supply element by the optionally driven application element and thus fed to the application element and subsequently pushed to the supply element by the application element.

According to the disclosure, it is further provided that a first drive element 215 is connected on the drive side to the application device in order to move it along an application direction, at least while it is transferring the adhesive material 213 in the adhesive region 234 to the label tape. Furthermore, a second drive element 216 is provided in order to drive the supply element and/or the application element for feeding and discharging the transfer tape to and from the application element.

For example, the supply element can comprise one or more rotatably mounted rolls, wherein at least one of these rotatable rolls can be set in rotation by the second drive element 216 and can, for example, achieve a tensile force on the transfer tape so that it is guided in the direction of the application element in order to apply the adhesive material from the application element to the adhesive region 234 of the label 231, or to discharge the transfer tape from the application element after the application of the adhesive material.

Alternatively or additionally, the application element can comprise an application roll rotatably mounted about an axis of rotation and can be rotated or driven about the axis of rotation by the second drive element in order to discharge the transfer tape from the supply element and/or feed the transfer tape to the supply element.

The first drive element 215 and the second drive element 216 can comprise, for example, one or more servomotors or other electric motors and are optionally operable independently of one another so that the supply element 212 and/or the application element 211 can be driven independently of the movement of the application element along the application direction for feeding and/or discharging the transfer tape.

The application direction optionally runs in a direction that is perpendicular to the transport direction T, but within or parallel to the transport plane of the label tape. Other relative orientations of the application direction are also conceivable, so that this can also enclose an angle other than 90° with the transport direction T, for example. This can be advantageous if adhesive material is to be applied to a larger region of the label tape 231 in the transport direction T.

In one embodiment, the apparatus 200 further comprises a connecting device 205 with which the first label end and the second label end can be connected together. For this purpose, the connecting device 205 can comprise one or more clamps 251 and 252 which can grip one of the label tapes and move it to the other label tape for connecting in the adhesive region 234. It can also be provided that the elements 251 and 252 are configured in such a way that they can pull up sleeve labels in a direction perpendicular to the transport plane of the label tapes in order to slip the sleeve label pulled up in this way over the other label end, which is optionally provided with adhesive material, and thus achieve a connection. The connecting device 205 can also be designed to exert pressure on the label tapes in the region of the adhesive region 234 after bringing into position the label ends so that they come into physical contact with one another in the adhesive region and, in particular, a connection is formed with the adhesive material.

Optionally, the apparatus 200 can also comprise a fixing element 204 that can fix the first label end 235 in the adhesive region 234 at least during the application of the adhesive material 213. For this purpose, in one embodiment, the fixing element 204 can comprise two pressure elements 241 and 242 spaced apart from one another in the transport direction, which can press on the label tape 231 in order to fix it upstream and downstream from the adhesive region 234. Alternatively, it can also be provided that the fixing element comprises only one pressure element upstream or downstream from the adhesive region 234 (i.e., either the pressure element 241 or the pressure element 242) in order to fix the label end at least in a region that is optionally directly adjacent to the adhesive region 234. The fact that the region is directly adjacent to the adhesive region can mean that the distance between the region and the adhesive region is less than 2 cm or less than 2 cm or less than 0.5 cm.

In the embodiment shown here, the second adhesive application device 262 comprises a corresponding fixing element 243. This can be advantageous in particular if, as described above, sleeve labels are to be connected to the apparatus according to the disclosure. The configuration of the fixing element 243 can be analogous to the fixing element 204. If single labels (i.e., no sleeve labels or label sleeves) are connected together with the apparatus 200, a fixing element 204 is sufficient, wherein this can optionally press the label tape 231 against a stop or counter element not shown here, so that the adhesive region 234 is fixed in the transport direction T.

It can be provided that the distance between the pressure elements 241 and 242 (if two are provided) in the transport direction is equal to (or slightly greater, for example up to 0.5 cm or up to 1 cm or up to 2 cm, than) the extent of the adhesive region 234 in the transport direction T so that the application element 211 can optionally apply adhesive material over the entire adhesive region 234 without it coming into contact with the pressure elements 241 and 242. In particular, it can be provided that the application element applies the adhesive material to the adhesive region between the pressure elements.

The pressure element(s) can, for example, be connected to springs that, upon a movement of the fixing element 204 in the direction of the label tape 231, ensure that the force transmitted by the pressure element(s) 241 and 242 to the label tape 231 does not exceed a certain maximum value. In particular, the spring elements can be pretensioned in the direction of the label tape 231 so that, on the one hand, physical contact with the label tape is reliably achieved by the pressure element(s) 241 and 242 and, on the other hand, a maximum force acting on the label tape is not exceeded.

It can be provided that the application element 211 and/or the fixing element are arranged movably in a direction perpendicular to the transport plane or to the plane of the label tape 231 so that they can be moved for applying and fixing the label tape 231. This can ensure that the adhesive material is applied if the label tape is reliably fixed and, on the other hand, that the label tape can be reliably transported further in transport direction T after the application of the adhesive material and/or connection to the other label tape.

The apparatus 200 can further comprise a cutting device 202 which can cut to size the label end 235 of the first label tape 231. For this purpose, the cutting device 202 can comprise, for example, a cutting blade 261 movable in the direction of the label tape and can furthermore comprise a counter element 263 arranged on the opposite side of the label tape 231, against which the cutting blade 261 with the label tape 231 located therebetween can be guided so that the label tape is reliably cut. This is not absolutely necessary, and it can also be provided that the respective label end 235 is already pre-cut so that the distance between the adhesive region 234 and the actual end of the label tape 231 is always constant, and thus a reliable connection of the label tapes is possible.

Furthermore, the apparatus 200 can optionally comprise a clamping element 203 upstream from the adhesive application device 201 in order to clamp the label tape 231 and secure it against further movement in the transport direction T. This clamping element can either be arranged on opposite sides of the label tape or the transport plane of the label tape 231, or only one such clamping element 203 can be movably provided in order to press the label tape 231 against a counter-pressure surface 239.

In one embodiment, a control unit 280 is further provided which can control one or more functions of the apparatus 200. The control unit can, for example, be designed as a computer with an associated processor and memory, and have suitable programming and corresponding connections for data exchange in order to control individual functions of the apparatus 200.

In particular, it can be provided that the control unit 280 can control the first drive element 215 and the second drive element 214 in order to operate them either synchronously or asynchronously. Here, the synchronous driving of the first drive element and the second drive element is to be understood in particular to mean such an operation that the distance traveled by the application element along the application direction is equal to the distance traveled by the transfer tape 211 so that the transfer tape does not come to rest on the label tape. Asynchronous operation is to be understood in particular to mean that the path traveled by the transfer tape is different from the path traveled by the application element in the application direction, and/or that the forces acting on the application element in the application direction are different from the forces acting on the transfer tape in terms of their magnitude. This ensures reliable detachment of the transfer tape from the applied adhesive material.

Figure 3:
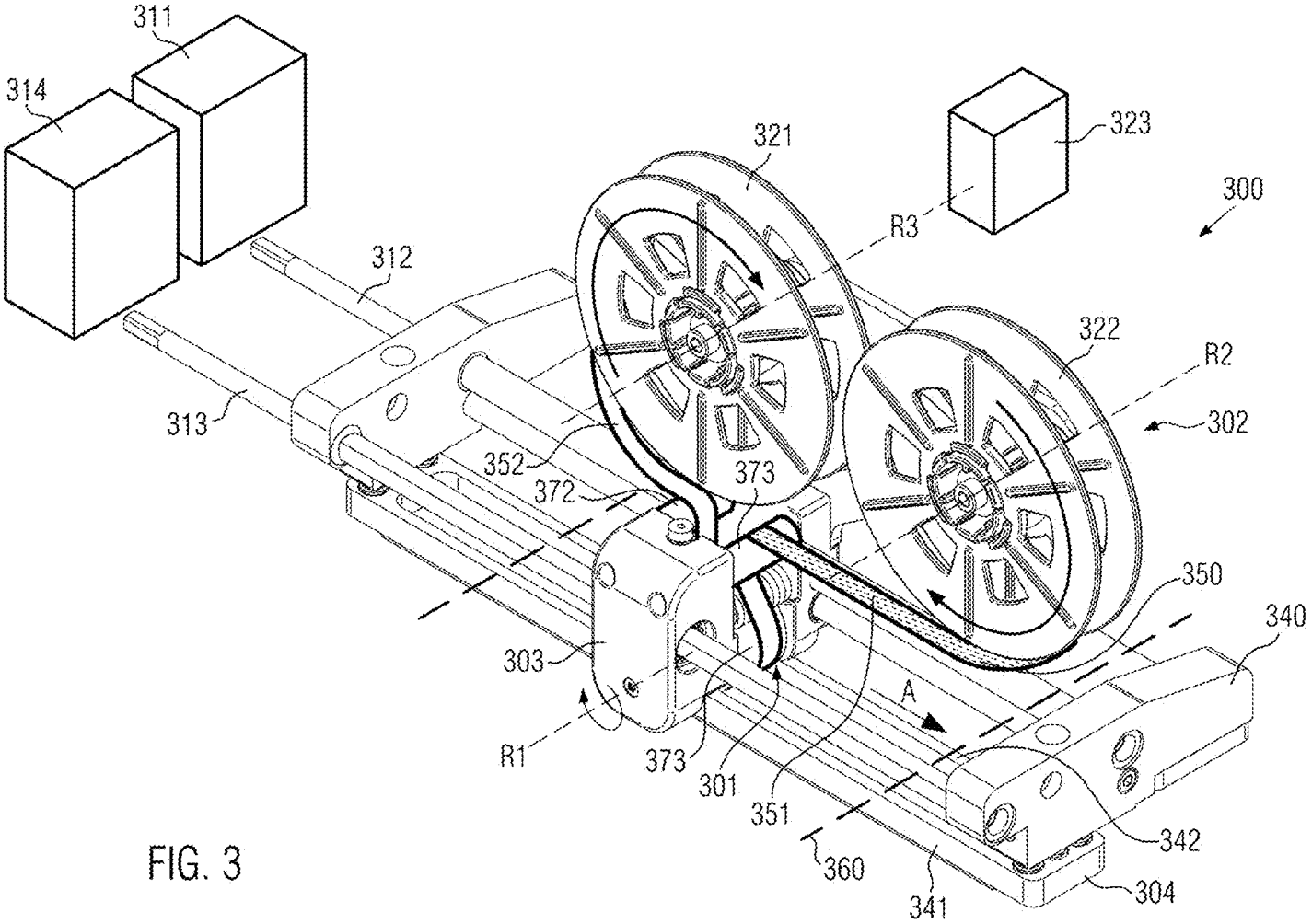
FIG. 3 shows an embodiment of the adhesive application device, the supply element and the first and second drive elements.

FIG. 3 shows an embodiment of an adhesive application device 300 in relation to a fixing element 304, as can optionally be provided.

In the embodiment shown here, the adhesive application device 300 comprises a frame 340 that is fixed in the apparatus (see FIG. 2) and with respect to which the application element 301 and the supply element 302 are movably arranged. In the embodiment shown here, the application element 301 and the supply element 302 are arranged together on a holding frame 303 so that the basic relative position between the application element 301 and the supply element 302 cannot be changed. This is therefore not mandatory.

With respect to the holding frame 303, the application element 301 and the supply element or components of the supply element can be arranged to be movable (in particular, rotatable about suitable axes of rotation). In the embodiment shown here, the application element 301 and in particular the entire holding frame 303 is arranged to move along an application direction A.

Here, the application element 301 comprises an application roll 373 which is rotatably mounted in the holding frame 303 about an axis of rotation R1 and accordingly follows a rotation upon movement along the application direction A. Optionally, the application element can comprise a first deflection roll 371 and/or a second deflection roll 372 which in each case can be rotatably mounted about an axis of rotation that runs parallel to and spaced apart from the axis of rotation R1. In particular, it can be provided that a distance between the axes of rotation of the first and/or second deflection roll 371, 372 and the axis of rotation R1 in the application direction A is smaller than the sum of the radii of the application roll and the respective deflection roll. This ensures that sufficient tensile forces act on the transfer tape, and that the transfer tape lies as tightly as possible against the application roll. Optionally, it can be provided that the application roll 373 can be moved together with or independently of the deflection roll(s) in a direction perpendicular to the transport plane of the label 360 towards or away from the label so that a tensile force and/or clamping force acting on the transfer tape can be adjusted.

The first drive element 311 (for example, an electric motor, in particular a servo drive) is provided for moving the application element 301 or the holding frame 303 in the application direction A transversely to the transport direction of the label or label tape 360. In the embodiment shown here, this is connected to the holding frame 303 via a spindle 312 rotatably mounted in the frame 340. However, any other embodiment is also conceivable.

In addition to the spindle 312, a guide 313 can be provided in one embodiment, on which the holding frame 303 is movably arranged in the application direction A.

If the holding frame 303 with the application element 301 is now moved in application direction A by actuating the spindle 312, the application roll rolls off on physical contact with the label tape 360 due to the arising frictional forces.

In the shown embodiment, the supply element 302 comprises a dispensing roll 322 on which transfer tape 350 with adhesive material 351 arranged thereon is held. The dispensing roll 322 is rotatably mounted about an axis of rotation R2 which can in particular be parallel to the axis of rotation R1 of the application roll. The axis of rotation R2 can also enclose an angle with the axis of rotation R1, and it can be provided that further guide rolls (not shown here)

are supplied which achieve a deflection or guidance of the transfer tape 350 with the adhesive material 351 in such a way that a crease-free deflection of the transfer tape 350 from the axis of rotation R2 and the associated direction of movement of the transfer tape 350 to the direction of rotation defined by the axis of rotation R1 is effected.

Furthermore, the supply element 302 comprises a pick-up roll 321 which is rotatably mounted about an axis of rotation R3 which optionally runs parallel to the axis of rotation R2 and optionally parallel to the axis of rotation R1. The pick-up roll 321 is arranged to roll up or pick up the transfer tape 352 after passing the application roll and after the adhesive material 351 has been removed or substantially removed.

Due to the second drive element 323, which in one embodiment can be connected on the drive side with the dispensing roll 322 and/or the pick-up roll 321, the transfer tape 352 can be set in motion in the direction from the dispensing roll to the pick-up roll so that it is fed to the application roll and thereafter removed and rolled up from the dispensing roll 321.

The control unit described in connection with FIG. 2 can control the first drive element 311 and the second drive element 323 in such a way that the same amount of transfer tape 350 is unrolled from the dispensing roll 322 as the distance covered by the application roll along the application direction A. This ensures that the transfer tape 350 does not tear during the transfer of the adhesive material 351 to the label tape 360. Subsequently, for example, upon reaching the end position of the application roll 301 in application direction A, the first drive element 311 can be stopped (for example, by appropriate actuation by the control unit) so that there is no further movement. In addition, either at the same time or at a small time interval therefrom (for example 0.1 s or more or 0.05 s or more), there can be further rotation or at least an effect of the torque from the second drive element 323 on the dispensing roll and/or the pick-up roll so that the transfer tape is moved further, and the adhesive material 351 transferred to the label tape 360 is separated from the transfer tape 352.

Optionally, the second drive element 323 is at least connected to the pick-up roll 321 since this can exert a tensile force on the transfer tape 351. A connection to the dispensing roll can also be provided. However, this is not mandatory, and the dispensing roll can be passively set in rotation by the tensile force acting on the transfer tape 350. This prevents an excess of transfer tape upstream from the application roll if more transfer tape 350 is unrolled from dispensing roll 322 than is rolled up from pick-up roll 321.

As an alternative to driving one of the rolls of the supply element, it can also be provided, corresponding to FIG. 3, that the second drive element is connected to the application roll 373 on the drive side as a second drive element 314 in order to drive the application roll 373 about the axis of rotation R1. Not shown here, one of the other rolls such as for example a deflection roll 371, 372 can alternatively be connected on the drive side to the second drive 314 in order to (indirectly) drive the application roll 373 about the axis of rotation R1. In this embodiment, it can be provided that the guide 313 is not provided as a passive guide that merely guides the movement of the application element 301 along the application direction A, but is additionally or alternatively designed as a spindle or square spindle in order to transmit the drive force of the second drive element 314 to the application roll 373. Analogous to the embodiment in which the second drive element 323 is connected to one of the rolls of the supply element, a control of the drive force transmitted by the second drive element 314 to the application roll can be controlled so that the described embodiments can also be applied analogously to this embodiment.

As shown, the application roll is moved in application direction A between the pressure elements 341 and 342 of the fixing element 340. In this case, the extent of the application roll 301 measured in the transport direction T or from one printing element 341 to the other printing element 342 can be smaller than the distance between the printing elements 341 and 342 so that the application roll 301 can optionally be placed between the printing elements 341 and 342 and pressed onto the label tape 360 so that the adhesive material 351 is reliably transferred.

The invention claimed is:

1. An apparatus for connecting label tapes, the apparatus comprising a feed-through region through which the label tapes can be guided along a transport direction, an adhesive application device for applying adhesive material to an adhesive region of a first label end of a first label tape, wherein the adhesive application device comprises an application element for applying the adhesive material in the adhesive region and a supply element for feeding a transfer tape with adhesive material to the application element and for discharging the transfer tape from the application element, wherein the apparatus comprises a first drive element for moving the application element along an application direction and a second drive element for driving the application element and/or the supply element for feeding and discharging the transfer tape;

wherein the apparatus further comprises a fixing element for fixing the first label end during application, wherein the fixing element comprises two pressure elements spaced apart in the transport direction which can fix the first label end, and wherein the application element can apply the adhesive material to the adhesive region between the pressure elements; or wherein the apparatus comprises a fixing element for fixing the first label end during application, and wherein the fixing element comprises a pressure element arranged downstream or upstream from the application element in the transport direction, which can fix the first label end.

2. The apparatus according to claim 1, wherein the first and second drive elements can be operated independently of one another.

3. The apparatus according to claim 2, wherein the apparatus comprises a control unit for controlling the first and second drive elements, wherein the first drive element and the second drive element can be operated synchronously during at least a first time interval and asynchronously during a second time interval.

4. The apparatus according to claim 1, wherein the application direction is perpendicular to the transport direction.

5. The apparatus according to claim 1, wherein the supply element comprises a dispensing roll on which the transfer tape with adhesive material can be held, and a pick-up roll for picking up the transfer tape after discharge, and wherein the second drive element is designed to drive the pick-up roll about an axis of rotation of the pick-up roll, wherein the axis of rotation optionally runs parallel to the transport direction.

6. The apparatus according to claim 1, wherein the fixing element and/or the application element is movable perpendicularly to a transport plane of the label tapes.

7. The apparatus according to claim 1, wherein the application element comprises an application roll for applying the adhesive material, and wherein the application roll is arranged rotatably about an axis of rotation parallel to the transport direction, and wherein the second drive element can drive the application roll about the axis of rotation, and/or wherein the second drive element can drive a deflection roll for deflecting the transfer tape about an axis of rotation of the deflection roll.

8. A method for connecting label tapes with an apparatus for connecting label tapes, the apparatus comprising a feed-through region through which the label tapes can be guided along a transport direction, an adhesive application device for applying adhesive material to an adhesive region of a first label end of a first label tape, wherein the adhesive application device comprises an application element for applying the adhesive material in the adhesive region and a supply element for feeding a transfer tape with adhesive material to the application element and for discharging the transfer tape from the application element, wherein the apparatus comprises a first drive element for moving the application element along an application direction and a second drive element for driving the application element and/or the supply element for feeding and discharging the transfer tape, the method comprising driving the application element and/or supply element for feeding the transfer tape to the application element, applying the adhesive material to the adhesive region, and discharging the transfer tape;

wherein the apparatus comprises a fixing element for fixing the first label end during application, wherein the fixing element comprises two pressure elements spaced apart in the transport direction, which fix the first label end at least temporarily during application, and wherein the application element applies the adhesive material to the adhesive region between the pressure elements; or wherein the apparatus comprises a fixing element for fixing the first label end during application, and wherein the fixing element comprises a pressure element arranged downstream or upstream from the application element in the transport direction, which can fix the first label end.

9. The method according to claim 8, wherein the adhesive material comprises an adhesive layer detachable from the transfer tape or a substrate detachable from the transfer tape with adhesive layers arranged on opposite sides of the substrate.

10. The method according to claim 8, wherein the application direction runs perpendicularly to the transport direction, and/or wherein the supply element comprises a dispensing roll on which the transfer tape with adhesive material is held, and a pick-up roll on which the transfer tape is picked up after discharge, and wherein the second drive element is designed to drive the pick-up roll about an axis of rotation of the pick-up roll, wherein the axis of rotation optionally runs parallel to the transport direction;

or wherein the application direction runs perpendicularly to the transport direction, and/or wherein the application element comprises an application roll for applying adhesive material, and wherein the second drive element drives the application roll about an axis of rotation, and wherein the axis of rotation optionally runs parallel to the transport direction;

or wherein the application element comprises a deflection roll for deflecting the transfer tape, and wherein the second drive element drives the deflection roll about an axis of rotation.

11. The method according to claim 2, wherein the fixing element and/or the application element are moved perpendicularly to a transport plane of the label tapes in the direction of the first label end prior to application.

12. The method according to claim 8, wherein the apparatus comprises a control unit that controls the first and second drive elements, wherein the first drive element and the second drive element are operated synchronously during at least a first time interval and asynchronously during a second time interval.

13. The method according to claim 12, wherein the first drive element and the second drive element are operated synchronously during application and are operated asynchronously for detaching the applied adhesive material from the transfer tape.

* * * * *